United States Patent [19]

Crutchfield et al.

[11] 4,365,018

[45] Dec. 21, 1982

[54] IMAGING ELEMENT AND AN IMAGING TECHNIQUE

[75] Inventors: E. Bryant Crutchfield, Dayton; Richard F. Wright, Chillicothe; Paul C. Adair, Chillicothe; Seth O. Harris, Chillicothe; Dale R. Shackle, Chillicothe; Dennis L. Williams, Chillicothe, all of Ohio

[73] Assignee: The Mead Corporation, Dayton, Ohio

[21] Appl. No.: 262,015

[22] Filed: May 11, 1981

[51] Int. Cl.[3] ..... G03C 5/04

[52] U.S. Cl. ..... 430/139; 430/138; 430/353; 430/395; 430/495; 430/496; 430/523; 430/616; 430/617

[58] Field of Search ..... 430/138, 139, 350, 395, 430/495, 496, 502, 503, 617, 353, 523; 427/157; 252/188.3 CL

[56] References Cited

U.S. PATENT DOCUMENTS

| | | |
|---|---|---|
| 1,565,256 | 12/1925 | Christensen . |
| 2,321,046 | 6/1943 | Rudnick . |
| 2,321,249 | 6/1943 | Rudnick . |
| 2,322,082 | 6/1943 | Wynd et al. . |
| 2,327,826 | 8/1943 | Sherwood . |
| 2,332,038 | 6/1943 | Wynd et al. . |
| 2,409,162 | 10/1946 | Staud . |
| 2,441,010 | 5/1948 | Dobbins . |
| 2,663,655 | 12/1953 | Miller et al. . |
| 2,672,416 | 3/1954 | Stanton . |
| 2,740,895 | 4/1956 | Miller . |
| 2,740,896 | 4/1956 | Miller . |
| 3,933,488 | 1/1976 | Noguchi et al. ..... 430/139 |

OTHER PUBLICATIONS

Broz, Chemical Abstracts, vol. 68, p. 10644, Item 110295m, 1968.

*Primary Examiner*—J. Travis Brown
*Attorney, Agent, or Firm*—Biebel, French & Nauman

[57] ABSTRACT

A self-exposing imaging element is disclosed comprising a support member, a light sensitive layer, and a layer containing reagents which will chemically react in a chemiluminescent reaction to produce light which exposes the light sensitive layer when in contact with an original. Reagents in the light generating layer are physically or chemically segregated prior to exposure to prevent reaction, for example, by encapsulation of one of the reactants, the reaction solvent, or a catalyst. To copy the self-exposing imaging element is placed in contact with an original, the light generating layer is activated by causing the reactants to mix or introducing the reaction solvent or catalyst and the radiant energy generated produces an image of the original in the radiation sensitive layer by reflex imaging or direct transmission imaging.

36 Claims, 4 Drawing Figures

IMAGING ELEMENT AND AN IMAGING TECHNIQUE

BACKGROUND OF THE INVENTION

The present invention relates to light sensitive imaging elements for making copies of an original and, more particularly, to an imaging element having a self-contained chemical source of radiant energy which, when activated, emits light by a chemiluminescent reaction and exposes a light sensitive imaging layer also contained in the imaging element.

Imaging elements and methods employing a light sensitive layer in combination with a luminescent material are known. In contrast to the present invention, however, in these prior materials the luminescent layer is powered by external radiation such as X-rays or visible light and it is not activated by chemical reaction.

U.S. Pat. Nos. 2,409,162 to Staud, 2,321,046 to Rudnick, and 2,327,826 are representative of a group of patents in which a luminescent template is formed and used to reproduce a line image. In their simpler forms, these templates comprise a fluorescent layer which is overcoated with an imaging mask containing the line image that is to be reproduced. Copies are made by exposing a separate photo-sensitive material, such as a light sensitive silver halide photographic film with the template. The mask containing the line image converts the surface of the template into fluorescent and non-fluorescent areas by intercepting the fluorescence in the non-image areas covered by the mask. In U.S. Pat. No. 2,409,162 the mask is an exposed and developed silver halide emulsion layer containing silver images. In U.S. Pat. No. 2,321,046, the mask is an opaque layer which has been selectively removed by, for example, etching in areas corresponding to the line image.

U.S. Pat. No. 2,672,416 to Stanton and U.S. Pat. No. 2,441,010 to Dobbins disclose reflex imaging techniques employing luminescent layers as an exposure source. In Stanton, a luminescent material is spot deposited on the surface of a transparent film which is interposed between a photo-sensitive film and an original. An opaque shield is associated with each spot deposit. In producing copies, the luminescent material is aligned such that luminescence is directed toward the original and is shielded from the photographic film by the opaque shields associated with each spot deposit. Images of the original are reproduced in the photo-sensitive layer by means of light which is emitted from the luminescent deposits and reflected by the original. In Dobbins, imaging is performed by placing a sheet of luminescent material over the original, activating the luminescent material, and laying on the surface of the luminescent sheet a photo-sensitive material. The photo-sensitive material is exposed by light from the luminescent material which is reflected from the surface of the original.

The present invention is an alternative to conventional photocopy systems. A principal drawback of most of those systems is the complex and expensive machinery which is involved. The expense of this machinery makes it economically impractical for the user who requires only a relative few copies. Thus, there is a need for a system by which copying can be accomplished with less expensive machinery or without machinery altogether.

SUMMARY OF THE INVENTION

A principal object of the present invention is to provide an imaging element and an imaging technique by which copies can be obtained simply and with a minimum of external processing.

A more specific object of the present invention is to provide an imaging element which contains its own exposure source in the form of a layer containing reagents capable of reacting chemically to generate light energy and which is capable or providing copies by simply superimposing the imaging element on the original and activating the light generating layer.

Another object of the present invention is to provide a light sensitive imaging element which is exposed by light emitted from a chemiluminescent reaction system contained in one or more layers of the imaging element.

A further object of the present invention is to provide an imaging technique in which an imaging element satisfying the above objects is placed adjacent the original and activated and images are formed by exposing a light sensitive layer to radiant energy emitted from another layer of the same element.

These and other objects are attained in the present invention which provides an imaging element comprising a support member, a light sensitive imaging layer and a light generating unit comprising one or more layers containing reagents which will chemically react and produce light energy which exposes the light sensitive imaging layer in the imaging element of the present invention. (The term "light" as used herein includes ultra violet and infra red as well as visible radiation. The term "unit" as used herein refers to the one or more layers in the imaging element which are associated with the light generating function.) In accordance with the invention, the chemical reactants in the light generating layer form a chemiluminescent reaction system. At all times prior to imaging, these chemical reactions are prevented from occurring by physically separating one or more of the reactants or a reaction solvent or catalyst from the balance of the system (hereinafter this group of materials is referred to as "reagents"). This can be accomplished by a variety of techniques including encapsulting one or more of the reagents, incorporating one or more of the reagents in a distinct layer in the imaging element from which they cannot diffuse until imaging is desired, or by reserving one or more of them from the imaging element. Prior to copying, the imaging element is activated such that light is produced in the light generating unit by, for example, breaking microcapsules, coalescing or melding the layers or applying the reserved substance to the imaging element. Any stable chemiluminescent reaction can be used in the light generating unit including reactions employing luminol or an oxalate ester.

The reaction system used in the light generating unit and the light sensitive material used in the imaging layer are selected such that the material in the imaging layer is sensitive to the light energy produced upon reaction of the light generating unit. If the light sensitive material in the imaging element is insensitive to ambient light, the imaging element can be handled in daylight. Preferably, images are formed in the imaging layer directly by exposure and without external development processing. One convenient system requiring development processing employs a thermally developable photographic material as the imaging layer. In this embodiment of the invention, images are developed by simply heating the imaging element after exposure. The heat used for development may be generated externally as from a heated platen or the like, or in accordance with still another embodiment of the invention, the heat may be generated in situ by reagents carried in a layer of the imaging element which react exothermically when mixed with other reagents.

DETAILED DESCRIPTION OF THE INVENTION

Figure 1:
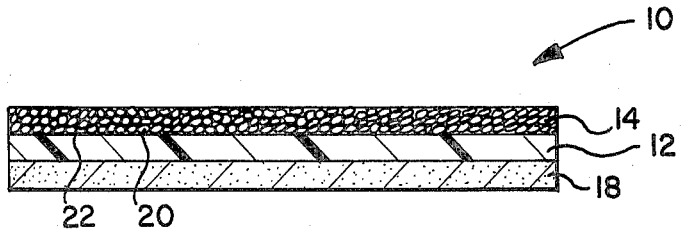
FIG. 1 is a cross-section of one imaging element in accordance with the present invention.

One example of the imaging element of the present invention is shown in FIG. 1 where it is generally indicated by the reference numeral 10. In one of its simpler forms, the imaging element of the invention comprises a transparent support member 12, a light generating layer 14, and a light sensitive imaging layer 18. As previously stated, the light generating layer 14 contains chemical reagents which are part of a reaction system which generates light energy when active, but are maintained in a physically or chemically distinct relation which prevents them from reacting when the imaging element 10 is not in use. FIG. 1 illustrates an embodiment where one of the essential reagents is in microcapsules 20 which are dispersed in a polymer binder 22 containing the other reagents. Other designs for preventing the reaction are discussed below. The light generating layer 14 and the light sensitive imaging layer 18 may also be coated on the same side of the support in either order.

Figure 2A:
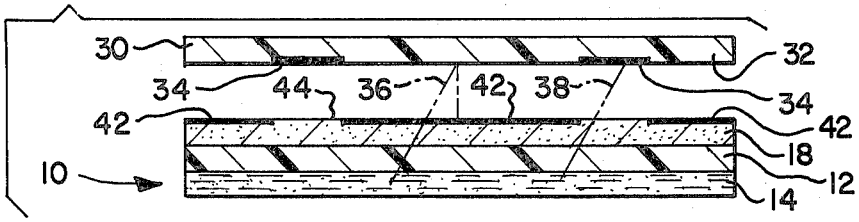
FIGS. 2A and 2B illustrate exposure of a light-sensitive imaging element in accordance with the present invention.
Figure 2B:
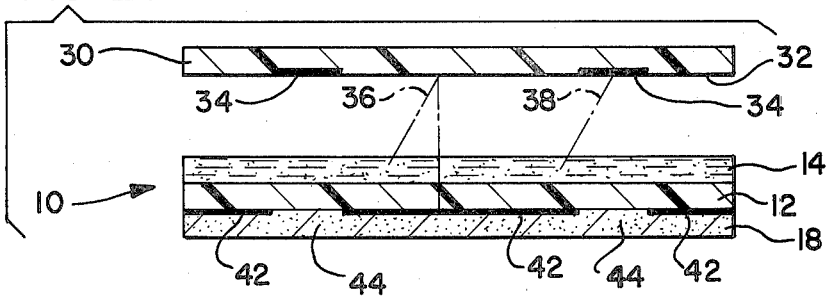

FIGS. 2A and 2B illustrate imaging in accordance with the invention. The imaging element 10 is placed adjacent and more particularly in contact with an original 30 having reflective areas 32 and non-reflective areas 34. Typically the reflective areas 32 are the white background areas of a paper sheet or the untyped areas of a document and the non-reflective areas 34 are the printed material. Prior to copying the imaging element 10 must be activated, i.e., it must be acted on such that the chemical reagents in the light generating layer 14 react and emit light. When microcapsules are employed in the light generating layer 14 the imaging element may be activated by applying a pressure to the material which causes the microcapsules to break, by applying heat which melts the microcapsules, or by otherwise rupturing the microcapsules to cause release of the reactants they contain. This is shown in FIG. 2 by the uniformity of layer 14 at the time of copying.

Reflex imaging is used in the embodiments of invention illustrated in FIG. 2. Two techniques may be used which are illustrated respectively in FIGS. 2A and 2B. In FIG. 2A the imaging element 10 is positioned next to original 30 with its light-sensitive imaging layer 18 closest the original. For illustration the imaging element 10 is shown at a position spaced from the original 30, in use the two are preferably in contact. With this arrangement light emitted from the light generating layer 14 passes through the light sensitive imaging layer 18 as shown by lines 36 and 38. Upon striking the original the exposure energy is reflected if it impinges reflective area 32 as shown by line 36. If it strikes a non-reflective or printed area such as 34 it is absorbed as shown by line 38. Exposure energy 36 reflected from the original srikes the imaging layer 18 in area 42 as a direct and reflected ray. Images are formed by the difference in exposure in areas 42 and 44. In area 42 light strikes the imaging layer 18 with a higher intensity than in the area 44. As a result of the difference in exposure between areas 42 and 44 images are produced in the imaging layer 18. Depending on whether the light-senstive material in the imaging layer 18 is positive or negative working material the images formed will be positive or negative images of the original. The image formed may be a latent image which requires development processing to be visible or a visible image may be formed directly upon exposure as a change in the color or opacity of the imaging layer.

FIG. 2B illustrates exposure with the imaging element 10 aligned with its light generating layer 14 closest the original 30. Operation of the imaging element is the same. Images are formed in the imaging layer 18 by the difference in exposure between the reflective and non-reflective areas of the original. As before the imaging layer is exposed by the radiation directly emitted from the light generating layer 14, but in area 42 corresponding to the reflective portion 32 of the original there is additional exposure by the radiation reflected from the original. As a result there is a difference in the intensity of the radiation striking the imaging layer in the areas 42 and 44 which produces images. The images formed by reflex imaging as in FIG. 2 are reverse or mirror images and must be read from the side of the element opposite the side of exposure when they are assymetrical or contain numbers or letters.

In another embodiment of the invention, direct transmission imaging can be used. In accordance with this embodiment, the imaging element is constructed with two plys, the first ply carrying the light generating layer unit and the second ply carrying the light sensitive imaging layer. Prior to exposure the original is inserted between the plys, the light generating layer is activated and using the original as a type of exposure mask, the light sensitive layer is imagewise exposed.

Having described the imaging element and technique used in the present invention, the various elements making up the imaging element of the present invention are defined below in more detail.

Support member 12 must be transparent or translucent. Translucent materials are advantageous because the image can be seen through the support member and the support member provides a degree of backscattering which makes the images easier to read. A typical transparent support member is polyethylene terephthalate film. A typical translucent support member is Gilclear Paper (a product of Gilbert Paper Co., The Mead Corporation). Where the light generating unit contains an encapsulated material which is activated by the application of pressure, a support member must be selected through which the capsules can be broken upon the application of pressure. On the other hand, where the imaging element is heated to activate it or to develop the images, an appropriate heat stable material must be selected. The imaging element may also be constructed so that the light generating unit 14 is strippable. In this case a second support member is provided which overlays the light generating unit. The second support member may be opaque and include a reflective layer. In the latter embodiment the second support member would need to be removed to read an image. In some cases it is desirable to construct the imaging element so that the light generating unit can be removed prior to development, but materials which can be used without removing the light generating unit are more convenient to use.

The operational center of the imaging element of the present invention is the light generating unit. Depending on the sensitivity of the light sensitive materials in the imaging layer, the light energy produced in the light generaring unit may be from the entire spectrum of radiant light energies, including visible light as well as infrared and ultra violet radiation.

The light generating unit contains all or a portion of a chemiluminescent reaction system. During storage and when the imaging element is not being used for copying, this unit must be maintained in a non-reactive state. This is accomplished by physically separating the essential reactants, the reaction catalyst or solvent from the system. Various techniques can be used for this purpose.

One of the principle techniques is illustrated in FIG. 1 and involves encapsulating one or more of the reactants which are essential for the chemiluminescent reaction or a reaction solvent or catalyst in a capsule of a polymeric or high molecular weight material. Encapsulation processes and capsule forming materials and emulsions are well known. Any known material and technique is suitable for use in the present invention as long as it is capable of encapsulating the reagent, solvent or catalyst and provides a composition which can be coated as a layer of the imaging element. Some examples of microcapsules that can be formed are from gelatin, hydroxy propyl cellulose, silicate, and melamine-formaldehyde resin. Typically capsules containing one of the reagents for the energy producing reactions are coated as a binder dispersion as one layer of the imaging element of the present invention with the other reagent(s) dispersed outside the capsules in the same layer or in a contiguous layer(s). The imaging element is activated by breaking the capsules (e.g., by application of heat or pressure). This causes the encapsulated reagent to release and mix with other reagents in the layer or diffuse to a contiguous layer where they react and produce radiant energy.

Another technique that can be used to separate the reagent is a so-called resin dispersion. According to this practice, the reagents are not maintained in microcapsules per se but an emulsion of a solution of one of the reagents in a polymer or binder solution is formed. This emulsion is coated on a support and dried where it produces a binder matrix having dispersed therethrough droplets containing the reagent. Again, the imaging element may be activated by applying pressure, or by heating it slightly to cause the binder matrix to soften and release the reactive droplets. In this case the balance of the reaction system will generally be located in one or more contiguous layers to which the captive reactant diffuses and reacts.

Those skilled in the art will appreciate still other ways of maintaining the reagents separate. For example, one or more of the reagents may be contained in solution in a pressure-rupturable pod which is associated with the imaging element in such a fashion that the pod may be broken immediately prior to imaging causing its contents to uniformly spread and diffuse throughout the light generating unit. Another alternative is to incorporate reagents in separate layers of multi-layer light generating unit in such a fashion that the reagents do not diffuse between the layers until time for exposure. The reagents may be contained in separate relatively impermeable layers which are caused to meld, coalesce or otherwise breakdown and mix by the application of heat or pressure. In one of the embodiments of the present invention an oxidizing agent precursor is dispersed in a layer of paraffin wax to which a solvent diffuses. Upon mixing with the solvent, the oxidizing agent is released and diffuses to other layers making up the light generating layer unit where it reacts.

Still another method is to reserve one or more of the reagents from the imaging element and apply it from solution using a swab or other applicator. In another embodiment of the invention discussed below, a felt tip pen is modified and used as an applicator.

The reactants in the light generating unit are characterized by their ability to chemically react and produce light which causes a change in the imaging layer which results in the formation of an image. To be useful in the present invention, these reactions should occur quickly (as instantaneously as possible) and provide a high energy output over a short period of time (seconds). On the other hand, slower reactions which release energy over a prolonged period of time are also useful in the present invention as long as allowances are made for their longer activation time and slower rate of exposure.

A number of chemiluminescent systems can be used in the present invention. Luminol or 3-aminophthalhydrazide is perhaps the best known and most widely studied chemiluminescent compound. Luminol reacts under relatively mild conditions and produces sufficient light to expose conventional silver halide photographic materials. In general, the reactions necessary to produce light from Luminol or Luminol derivatives involve an initial reaction with a basic compound to form a dianion followed by reaction with an oxidizing agent to produce an electronically excited species which quickly decays to a stable ground state with the emission of light. A typical base for the reaction is sodium hydroxide and a typical oxidizing agent is a combination of hydrogen peroxide or a precursor thereof and potassium ferricyanide. Other bases and oxidizing agents that are suitable are reported in the literature.

To prevent reaction of the luminol system, it has been found convenient to overcoat a layer containing luminol, potassium ferricyanide and sodium hydroxide with a layer of microcapsules containing the oxidizing agent and, more particularly, hydrogen peroxide as the internal phase. Another alternative is to form an imaging element with the aforementioned luminol containing layer and apply a hydrogen peroxide solution separately before exposure.

Another chemiluminescent system that is particularly advantageous to use in the present invention is an oxalate ester chemiluminescent system. This system employs an oxalate ester which can be generally represented by the formula:

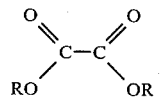

where R is an electronegatively substituted aryl group such as a 2- and/or 4-nitrophenyl group and a 2, 4, 6 trichlorophenyl group. This system comprises as its principal reactants the oxalate ester, an oxidizing agent, and a fluorescer. The oxidizing agent is preferably hydrogen peroxide or a precursor (e.g., a peroxo compound which will release hydrogen peroxide in the presence of water or an acid). The chemiluminescent reaction occurs by reacting the oxalite ester with hydrogen peroxide to form a dioxetanedione in a solvent. Dioxetanedione is very unstable and readily decomposes to carbon dioxide and releases energy. The energy released is transferred to the fluorescer which becomes electronically excited and emits light as it decays to its original ground state. When a hydrogen peroxide precursor is used the system includes an agent which will react with the precursor and cause the release of hydrogen peroxide. Where, for example, the precursor is sodium perborate an acid (e.g., a mineral acid, 2-chlorobenzoic acid, or 3-bromo-benzoic acid) aids in decomposing the precursor. Suitable solvents for the oxalate ester system include tetrachloroethylene, phthalate esters, alcohols, benzene, toluene, etc.

The principal advantage of the oxalate ester system is that the wavelength of light emitted is independent of the oxalate ester used but is determined instead by the choice of fluorescer. Thus a wide range of wavelengths is available through this system by changing the fluorescer. In particular, near ultraviolet light can be produced by use of an appropriate fluorescent compound. Near ultra violet light is present in normal ambient light only to a very small extent and can be done to produce an image in an ultra violet light-sensitive material. By using a ultra violet light-sensitive material which is innately insenstive to visible light or rendered insensitive by building in shielding layers in combination with an oxalate ester system as the light source, an imaging element is obtained which can be handled in daylight.

Another attractive feature of the oxalate ester system is that the intensity and duration of the emitted light can be adjusted using appropriate catalysts. In this manner a system is possible which provides a high output over a very short period of time. See, for example, U.S. Pat. No. 3,729,426. Some preferred catalysts are: sodium salicylate, trihexylamine, dimethylbenzylamine, tributylamine, triethylamine, sodium trifluoroacetate, tetra(n-butylammonium) perchlorate, sodium hydroxide, ammonium hydroxide.

Representative fluorescers which can be used in the oxalate ester system in accordance with the present invention are shown in Table 1 below. As of this writing, one preference is 4-(N,N-diphenylamine) biphenyl.

TABLE 1

| U.V. Emitters | Maximum Wavelength of fluoresence (nm) |
|---|---|
| 4,(N,N—Dipehenylamine)-biphenyl | 384 (benzene) |
| Carbostyril 124 (Eastman) | 400 (Ethanol) |
| PBBO (Eastman) | 395 (Toluene) |
| PBD (Eastman) | 360 (Toluene) |
| PPO (Eastman) | 360 (Toluene) |
| p-Terphenyl | 335 (Toluene) |
| Anthracene | 388 (Benzene) |
| 1-Methyl-2-phenyl indole | 370 (aromatic) |
| 1-Biphenyl-2-phenyl indole | 370 (aromatic) |
| **Visible Light Emitters** | |
| 9,10-diphenylanthracene | |
| perylene | |
| rubrene (5,6,11,12-tetraphenylnaphthacene) | |
| Acridine Orange | |
| 3,6-bis-(dimethylamino) acridine | |

Those skilled in the art will appreciate that chemiluminescent systems other than those discussed above can be used in the present invention. Any system that is stable in the imaging element of the present invention can be used if it has a sufficient energy output to expose the imaging layer. Some other systems that can be used include tris (bipyridyl) ruthenium and related complexes; dioxetanes and particularly dioxetanes of the formula:

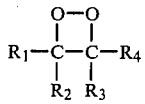

$R_1$, $R_2$, $R_3$ and $R_4$ may be any carbon-containing substituent such as alkyl, aryl (including polycyclic aryl), etc. Dioxetanones; acridine derivatives; diphenoyl peroxides; peroxy esters and particularly esters of the formula:

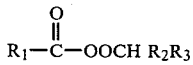

where $R_1$, $R_2$, $R_3$ can be any carbon containing group such as alkyl, aryl, etc.

The oxidizing agent can be encapsulated or applied separately. The oxalate ester and fluorescer are preferably coated on a sheet in a polymer layer. Hydrophobic polymeric resins such as polyvinyl acetate sarans, polyolefins (e.g., polyethylene), polyacrylics, polystyrenes, polyamides, etc., are suitable polymers. The polymer layer serves to bind the reagents to the support and preferably also protects the oxalate ester from hydrolysis by ambient water vapor. The material is activated by applying a solution of hydrogen peroxide to the sheet prior to exposure or rupturing a capsule layer containing a solution of hydrogen peroxide. One suitable solution is 10% butanol, 10% hydrogen peroxide and 0.002 M trihexylamine in butyl acetate. The solution may be applied by means of a pressure rupturable pod, a cotton swab or a solvent pen.

A light generating unit can also be formed by encapsulating the solvent for the chemiluminescent reaction system. This embodiment of the invention is illustrated in Table 2 below for the oxalate ester:

TABLE 2

| Oxalate Ester Unit | |
|---|---|
| Layer 1: | Suppport member. |
| Layer 2: | A layer of microcapsules containing a solvent for the chemiluminescent reaction which will permeate the unit, remain in the capsules to ensure a reasonable shelf life, and which is a good solvent for the reactants and the reaction. |
| Layer 3: | Hydrogen peroxide or a hydrogen peroxide precursor dispersed in a polymer binder. |
| Layer 4: | Oxalate ester, a fluorescer, and where a precursor is used in Layer 3, a solid organic acid as a promoter of peroxide liberation dispersed in a |

TABLE 2-continued

| Oxalate Ester Unit |
| --- |
| binder.) |

In a specific embodiment of the invention, in Layer 2 tetrachloroethylene is encapsulated in hydroxy propyl cellulose (HPC) capsules with 10% butanol. Layer 3 is a polyvinyl acetate dispersion of sodium perborate. Layer 4 contains, as the oxalate ester, 2,4 dinitrophenyl oxalate or 2,4,6 trichlorophenyl oxalate; as the fluorescer, rubrene, perylene, acridine orange, or diphenylanthracene; and bromobenzoic acid to aid in decomposition of the perborate in Layer 2. Upon application of pressure, the solvent is released from the capsules in Layer 2 and diffuses throughout Layers 3 and 4 and light is emitted. By varing the fluorescer, a wide range of wavelengths may be emitted.

Figure 3:
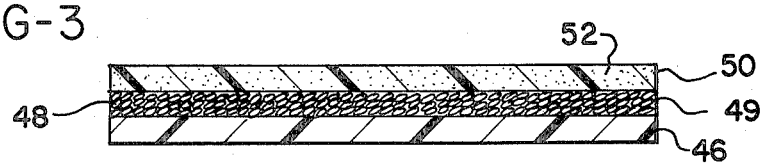
FIG. 3 illustrates one version of a light generating unit in accordance with the present invention.

Another light generating unit in accordance with the present invention is shown in FIG. 3. There a transparent support 46 is coated with a layer 47 of capsules 48 containing the fluorescer. This layer is overcoated with a layer of wax 50 having solid oxalate ester 52 dispersed therein. This unit is activated by applying a solution of hydrogen peroxide to the surface.

In making external application of reactants which have been withheld from the imaging element, one convenient tool is a so-called solvent pen. One solvent pen was made by adding fumed silica to the above composition to thicken the solution. The solution is placed in the ink cavity of a felt-tip marker using glass wool to hold the solution in place. The solvent pen cleanly dispenses an even coat of hydrogen peroxide on the surface of the imaging element. By varying the volatility of the solvent, the duration of emitted light can be varied.

The imaging layer used in conjunction with the chemiluminescent systems employs light-sensitive materials. Any of the conventional light-sensitive materials including light-sensitive silver halide can be used in the present invention. From the standpoint of facilitating the use and handling of the invention imaging element, preferred light-sensitive materials are those which are insensitive to ambient or room light or which can be rendered insensitive by the addition of blocking agents, screening agents and the like. Of course these materials must be sensitive to the radiant energy coming from the light generating unit. The inherent sensitivity of silver halide can be controlled to minimize its sensitivity to room light. This is generally done by adjusting the composition of the silver halide and/or the silver halide grain size. Light-sensitive silver halide materials which can be handled in room light are commercially available. Another means of accomplishing this is to incorporate a filtering agent such as a filter dye in the light-sensitive composition. Filter dyes are known which will shield the layer from room light, but which will decompose in certain solvents to render the material sensitive to visible light. Using these dyes, the imaging element can be handled in room light and reacted with a solvent prior to exposure to render the material sensitive to the radiant energy generated in the light generating layer. Other systems will also be apparent to those skilled in the art. Positive and negative images can be formed by employing a positive or negative working material in the imaging layer or by appropriate development processing.

Preferably the light-sensitive system is one which yields a visible image without requiring a developing agent. In this regard a suitable light sensitive material is a thermally developable silver halide material known as a "dry silver" material. Dry silver materials are commercially available from a number of manufacturers. In general these materials employ an organic silver salt such as silver behenate which thermally decomposes to provide an opaque image in the presence of a catalytic amount of metallic silver. Catalytic amounts of metallic silver are generated by exposing the sheet, which also contains a small amount of silver halide, to light generated in the imaging element and reflected from an original. When uniformly heated the dry silver material darkens in the areas in which the metallic silver has been produced by exposure.

More preferably, the light-sensitive system is self-developing, i.e., one which does not require a separate development step to develop the latent image. Such a material is so-called oscilloscope paper which forms an image upon exposure to light by the difference in fogging of silver halide grains.

Non-silver light-sensitive systems can also be employed in the imaging layer of the present invention. These systems are dye systems usually based on free-radical generation in the presence of light. One such system that can be used is the non-silver direct print out photographic system disclosed in U.S. Pat. No. 3,102,810.

Where a wet development processing is required, however, the developing agent may be contained in a pressure-rupturable container in much the same fashion as developing agents are applied in diffusion transfer photographic material. Otherwise, the developing agent can be applied externally after exposure.

Another light-sensitive material that can be used in conjunction with a chemiluminescent exposure system is a material which is insensitive to light and remains colorless when exposed in a solid form but which develops color when exposed to light in solution. These materials can be handled under ambient light and activated by applying solvent prior to imaging. For example, a self-contained sheet is formed incorporating the activation solvent for the light-sensitive material in microcapsules in one layer and incorporating the solid insensitive material in the same or another layer. By breaking the capsules to release the solvent for example, at the same time, capsules containing the chemiluminescent reactants are broken a light sensitive material is obtained. Otherwise the solvent can be contained in a pressure rupturable pod or externally applied prior to exposure. Light-sensitive materials which are insensitive as solids are disclosed in U.S. Pat. Nos. 3,090,687 and 3,149,120 to Berman.

As indicated, one embodiment of the present invention relies upon a thermally developable light sensitive material. Imaging elements in accordance with the invention employing this type of material in the light sensitive layer can be developed in a conventional fashion by, for example, passing the exposed material over a heated platen or through heated rollers. In another embodiment of the invention, however, the imaging element also carries a heat generating layer for development. This layer may be located anywhere in the invention element provided it does not interfere with exposure. Preferably it is located adjacent or on the opposite side of a support member from the light sensitive layer. The heat generating layer may be activated prior to exposure or after exposure and prior to development.

The presence of heat at the time of exposure can accelerate the exposure process. It can accelerate the chemiluminescent reaction and provide a higher pulse output requiring shorter exposure time where otherwise a more gradual output requiring a longer exposure would be obtained. Any exothermic reaction which is relatively spontaneous and for which the reagents are stable in the imaging element of the present invention can be utilized. One well known class of exothermic reactions is the reaction of a metal oxide or hydroxide with an acid. Representative examples of this class of reactions are shown in Table 3 below with their negative heats of reaction.

TABLE 3

Exothermic Systems

| Reaction | | H (Kcal/mol) |
|---|---|---|
| $CaO + H_2SO_4$ | $CaSO_4 + H_2O$ | −100 |
| $CaO + 2HC_2H_3O_2$ | $Ca(C_2H_3O_2) + H_2O$ | −40.4 |
| $Ca(OH)_2 + H_2SO_4$ | $CaSO_4 + 2H_2O$ | −80.7 |
| $Ca(OH)_2 + 2HC_2H_3O_2$ | $Ca(C_2H_3O_2)_2 + H_2O$ | −23.0 |
| $MgO + H_2SO_4$ | $Mg\ SO_4 + H_2O$ | −36.0 |
| $BaO + H_2SO_4$ | $BaSO_4 + H_2O$ | −91.2 |
| $Ba(OH)_2 + H_2SO_4$ | $BaSO_4 + 2H_2O$ | −66.7 |
| $BaO + 2C_2H_3O_2$ | $Ba(C_2H_3O_2)_2$ | −57.2 |
| $Ba(OH)_2 + 2C_2H_3O_2$ | $Ba(C_2H_3O_2)_2 + H_2O$ | −32.7 |
| $Mn + H_2SO_4$ | $Mn\ SO_4 + H_2O$ | −75.3 |
| $MnO + H_2SO_4$ | $Mn\ SO_4 + H_2O$ | −56.5 |
| $Mn(OH)_2 + H_2SO_4$ | $Mn\ SO_4 + 2H_2O$ | −46.9 |

For the purpose of the present invention, the reaction of calcium hydroxide with oxalic acid has provided the most useful energy found so far. By incorporating one of the exothermic reactants in polymeric capsules or a pod, or by applying a solution of one of the reactants to the imaging element prior to exposure, the reaction may be prevented until needed. A suitable solvent for the reaction is water, methanol, ethanol or mixtures thereof.

The present invention is further illustrated by the following non-limiting examples.

EXAMPLE 1

A PVA/toluene solution containing bis (2,4,6-trichlorophenyl) oxalate and 9,10 diphenylanthracene was coated on the non-emulsion side of a dry silver paper type 7742 (Minnesota Mining & Manufacturing Co.) under safelight conditions. After air drying at 30° C., the coated photographic paper was placed emulsion side down on a playing card. The oxalate coating was activated by applying a solution containing 80% butyl acetate, 10% butyl alcohol, 10% hydrogen peroxide, and 0.002 M trihexylamine catalyst. After exposure for several minutes the dry silver paper was removed and developed on a heated roller. The resulting image was clearly discernible.

EXAMPLE 2

A sheet of paper was successively coated with the following solutions with drying between each application:

(1) Hydroxy propyl cellulose capsules containing tetrachloroethylene as an internal phase. (2) 7 g $NaBO_3$ $4_2O$ in 25 ml water at 70° C. (3) 0.5 g 9,10-diphenylanthracene, 2 g bis (2,4,6-trichlorophenyl) oxalate and 2 g bromobenzoic acid in 15 ml polyvinyl acetate toluene. Under safelight conditions, a sheet of direct print silver halide photographic paper was placed emulsion side up on a table. A transparent mask bearing a positive image was placed on the print paper and the coated sheet prepared as above was placed coated side up on top of the transparency. Pressure was applied to the sheet using the rounded tip of glass rod and the light produced was readily visible. After exposure, the print paper was developed and an easily readible negative transmission copy was obtained. Next, under dark room conditions, a printed page was placed printed side up on a table. A sheet of transparent precision line film was placed emulsion side down on the page and the coated sheet prepared above was placed coated side up on top of the film. Some areas of the sheet were activated using a glass rod. Other areas were activated by rubbing the sheet with a swab dipped in peroxide catalyst solution. After developing, the film displayed readable negative images of the original.

EXAMPLE 3

$1.4\times10^{-3}$ moles of 3-aminophthalhydrazide were dissolved in 100 ml of 1% aqueous NaOH and diluted to 800 ml with water to form solution A. 80 ml of 3% aqueous potassium ferricyanide was added to 80 ml of 3% hydrogen peroxide and diluted to 800 ml with water to produce solution B. Solution A was sprayed on a transparent sheet and allowed to air dry. A small sheet of impact raw stock paper was dipped in solution B and while still damp placed on the coated side of the transparent sheet. A blue emission resulted which was clearly visible through the transparent sheet and which was suitable for imaging as in Example 1. The example was repeated by spraying solution B on the transparent sheet and a similar strong blue emission was obtained.

EXAMPLE 4

A solution prepared by dissolving 0.25 g luminol and 0.25 g potassium ferricyanide in 25 ml 1% NaOH was coated on a transparent sheet and dried.

Peroxide-containing capsules were then prepared by the following technique.

The following Solutions 1–3 were prepared:

| | | |
|---|---|---|
| Solution #1 | 3% $H_2O_2$ | 90 g |
| Solution #2 | Toluene | 150 g |
| | n-butyl acetate | 24 g |
| | polyvinylacetate | 12 g |
| Solution #3 | Toluene | 75 g |
| | n-butylacetate | 18 g |
| | Desmodur N-100 | 10.92 g |

Solution 1 was emulsified into Solution 2 for 15 seconds at low speed on an explosion proof blender. Solution No. 3 was then added and mixed 60 seconds. The mixture was milky in appearance and was transferred to a 3-neck flask for overnight curing at 40° C. Capsules containing 3% hydrogen peroxide in an aqueous inner phase approximately 8 microns in diameter (avg.) were obtained. These peroxide-containing capsules were topcoated over the luminol layer and dried. When crushed with a glass rod in a dark room a brief blue light was observed where the capsules were broken, releasing $H_2O_2$ to take part in the luminol reaction.

This example was repeated but with an intermediate application of 1% NaOH in water. In this case, a much brighter light was observed when the capsules were crushed with a glass rod which was suitable for imaging.

EXAMPLE 5

The following coatings were applied to a transparent sheet in sequence and with drying between applications: (1) A layer of hydroxy-propyl cellulose (HPC) microcapsules containing tetrachloroethylene as an internal phase. (2) 10 ml toluene solution containing 0.35 g of 9,10-diphenyl-anthracene saturated with 3-bromo and 2-chloro benzoic acids. (3) A 10 ml solution of 0.9 g polyvinyl acetate, 1.0 g bis (2,4-dinitrophenyl) oxalate, and 1.0 g $NaBO_3 4H_2O$ in toluene. When a glass rod was drawn across the coated sheet, a blue light was produced which was suitable for imaging as in Example 1.

EXAMPLE 6

A solution of 2.5 g bis-(2,4-dinitrophenyl) oxalate, 0.5 g 9,10 diphenyl-anthracene, and 1.35 g polyvinyl acetate in toluene was coated on a translucent sheet. After drying, a solution consisting of 80% butyl acetate, 10% t-butyl alcohol, and 10% $H_2O_2$ was applied to the sheet using a cotton swab. Bright blue light suitable for imaging was observed in the swabbed area.

EXAMPLE 7

Hydrogen peroxide was encapsulated in silicate microcapsules according to the procedure of U.S. Pat. No. 3,791,987. 10 g Dowex HCR-S-H ion exchange resin (Dow Chemical Co.) was covered with water for 30 minutes. 10 ml of 10% HCl was added with stirring. The resin was filtered and washed until the PH was 9.0. 40 ml of 10% sodium silicate was added with stirring to 70% of the resin. This was filtered and 25 ml of the resulting silicic acid was mixed with 50 ml water. Mixing in a Sunbeam blender was started. 25 ml of dibutyl phthalate (filtered through 5 A, 4 A and 3 A molecular sieves) was slowly added with 20 ml sec-butyl alcohol and 0.5 ml of 30% $H_2O_2$. 6 g of Carbowax (Gulf Oil Co.) was then added with 5 drops of $MgBr_2$ (aq). Stirring proceeded for two hours and capsules ranging from 2 to 8 microns in diameter were formed.

Capsules prepared as above were coated on a sheet previously coated with 0.25 g bis(dinitrophenyl) oxalate and 0.25 g anthracene in 10 ml toluene and dried. A glass rod was drawn across the paper and faint luminescence was noted in a dark room. When sodium silicate solution was coated as an intermediate coating, a brighter reaction was noted.

EXAMPLE 8

Hydroxy propyl cellulose capsules were prepared as in U.S. Pat. No. 4,205,455. 90.3 g of a solution prepared by dissolving 17.4 g of Klucel L (hydroxypropyl cellulose, Hercules Chemical Co.) in 564.9 g water was set aside as Solution A. 46.3 g of MIPB ((mono isopropyl biphenyl, Tantex Co.) was heated to about 90° C. for about 1 hour to remove water and cooled. 0.14 g of 9,10 diphenylanthracene (0.025 M) and 6.8 g of bis (2,4 dinitrophenyl) oxalate (0.33 M) was added to from Solution B. 3.72 g of Desmodur N-100 (Polyisocyanate, Mobay Chemical Co.), 1.2 g of SF 50 (a trifunctional aromatic polyurethane prepolymer from Union Carbide), 1 drop of T-12 catalyst (an organo tin compound, MT Corp.) and 9.5 g of Base H (odorless kerosene base) were added in order to Solution B after cooling to 10° C. allowing each addition to mix approximately 1 minute before the next. Base H was added slowly, over a period of 15–20 seconds. 1.3 ml of 5% NaOH and 0.5 g of Parez 707 (modified melamine formaldehyde resin, American Cyanamid) was added to Solution A above. Solution B was emulsified with Solution A using a Sunbeam blender. The emulsion was placed in a reactor vessel and heated to 48° C. while stirring. The temperature was held at 48° C. 1 while mixing for three hours. HPC capsules were obtained containing oxalate ester and fluorescer as the internal phase.

Capsules prepared as above were coated on a sheet of paper. Hydrogen peroxide was squirted onto the sheet with no visible light produced. When a glass rod was drawn across the page, light suitable for images in Example 1 was produced, indicating encapsulation.

EXAMPLE 9

Example 8 was repeated to produce HPC capsules containing 1.0 g bis(dinitrophenyl) oxalate, 0.5 g diphenylanthracene and about 0.1 g sodium salicylate as a luminescence catalyst. The capsules were found to lose their luminescent activity over the course of a month, but upon addition of $H_2O_2$ (30%) light suitable for imaging was produced by drawing a glass rod across the sheet.

EXAMPLE 10

An exposure source layer unit was prepared by coating a sheet with a layer of diphenylanthracene HPC fluorescer capsules and overcoating the capsule layer with a layer containing 2.5 g bis(2,4 dinitrophenyl) oxalate suspended in about 100 g melted Gulf Wax. After hardening, hydrogen peroxide was squirted on the surface of the sheet. Rubbing a glass rod across the sheet produced light suitable for imaging.

EXAMPLE 11

An exposure source layer unit was prepared by coating a sheet with HPC capsules containing the fluorescer used in Example 10 and overcoating the capsule layer with a second capsule layer of silicate capsules containing 10% acetic acid. This second layer was overcoated with a layer containing bis (2,4 dinitrophenyl) oxalate and sodium perborate suspended in about 100 g melted Gluf Wax. Again, upon drawing across the sheet with a glass rod, light suitable for imaging was produced.

EXAMPLE 12

An exposure source layer unit was prepared by coating a sheet with the fluoroescer capsule coating used in Example 10 previously. The fluorescer capsule coating was overcoated with a second layer of encapsulated acetic acid and dibutyl phthlate. These capsule layers were overcoated with a first layer of a paraffin-wax coating containing 32 g wax and 2 g of the oxalate ester used in the previous example. Sodium perborate was generously sprinkled as a fine powder on top of the wax layer. Light was produced when a glass rod was drawn across the sheet. The sheet was good after 20 hours and can be used for imaging as in Example 1.

EXAMPLE 13

An exposure source layer was produced by coating a transparent sheet in sequence with the following layers: (1) the HPC capsules containing TCE as an internal phase. (2) silicate capsules containing acetic acid as an internal phase prepared in Example 11, (3) diphenylanthracene powder, (4) a wax layer containing 2 g oxalate ester and 0.2 g diphenylanthracene and (5) sodium perborate powder. Fairly bright light suitable for imaging was produced when a glass rod was drawn across this sheet.

EXAMPLE 14

An exposure source layer unit was prepared by coating a translucent sheet with the following coatings in sequence: (1) an HPC capsule coating containing TCE as an internal phase. (2) a coating of toluene saturated with 2-chloro and 3-bromobenzoic acid, (3) a second coating of HPC capsules containing TCE as an internal phase, (4) a wax layer containing 33 g paraffin-wax, 0.4 g fluorescer and 2 g bis (2,4 dinitrophenyl) oxalate, and (5) solid perborate sprinkled as a fine powder on the wax layer. When this sheet was rubbed with a glass rod in contact with the dry silver material used in Example 1 images were formed.

EXAMPLE 15

The following coating compositions were coated on a paper sheet: (1) HPC capsules containing TCE. (2) a dry layer of acid and diphenyl anthracene deposited from a toluene solution saturated with 3-bromo and 2-chlorobenzoic acids containing 0.35 g diphenylanthracene and (3) a layer of polyvinyl acetate containing 1.0 g of bis (2,4 dinitrophenyl) oxalate and about 1.0 g $NaBO_34H_2O$ suspended in 10 ml polymer solution. This sheet was combined with a transparency and a silver halide sheet for transmission imaging and a direct negative image was obtained when a glass rod was drawn across the sheet in contact with the transparency and silver paper.

Having described my invention in detail, those skilled in the art will recognize that numerous variations and modifications are possible therein without departing from the invention as defined in the following claims:

What is claimed is:

1. An imaging element carrying a self-contained exposure source comprising:

a support member, a light sensitive imaging layer, and a light generating unit, said light generating unit comprising one or more layers containing at least one reagent from a chemiluminescent reaction system, said unit chemiluminescing upon reaction of said chemiluminescent system but said chemiluminescence being temporarily prevented from occurring in said unit by physically separating at least one reagent forming said reaction system, said light sensitive imaging layer containing a material which is sensitive to said chemiluminescence.

2. The imaging element of claim 1 wherein said light generating unit comprises a layer containing an encapsulated reagent.

3. The imaging element of claim 1 wherein said light generating unit comprises a layer having a reagent dispersed in a binder.

4. The imaging element of claim 1 wherein said element additionally comprises a pressure rupturable pod containing a solution of at least one reagent.

5. The imaging element of claims 1, 2 or 3 wherein said light generating unit comprises two or more layers.

6. The imaging element of claim 1 wherein said reagent is an oxalate ester.

7. The imaging element of claim 1 wherein said reagent is luminol or a luminol derivative.

8. The imaging element of claim 1 wherein said reagent is a fluorescer.

9. The imaging element of claim 1 wherein said reagent is a compound capable of being transformed to an excited state from which it emits energy.

10. The imaging element of claim 1 wherein said reagent is an oxidizing agent or a precursor thereof for said chemiluminescent reaction.

11. The imaging element of claim 9 wherein said light energy is ultra violet radiation.

12. The imaging element of claim 1 wherein said sensitive material is a light sensitive silver halide.

13. The imaging element of claim 1 wherein said light sensitive imaging layer is a thermally developable silver halide emulsion.

14. The imaging element of claim 1 wherein said sensitive material is a material which is insensitive to light in its solid form but is sensitive to light when dissolved.

15. The imaging element of claim 1 wherein said light sensitive imaging layer is insensitive to ambient light.

16. The imaging element of claim 1 wherein said light sensitive imaging layer is a positive or negative working material.

17. The imaging element of claim 1 wherein said sensitive material is a non-silver direct print-out material.

18. The imaging element of claim 13 wherein said element additionally comprises a heat generating layer.

19. The imaging element of claim 1 wherein said light sensitive imaging layer and said light generating unit are positioned on opposite sides of said support and said support is transparent or translucent.

20. A process for imaging which comprises:

positioning adjacent an original an image element including:

a support member, a light generating unit wherein said light generating unit comprises one or more layers containing at least one reagent of a chemiluminescent reaction system, said system being temporarily prevented from reacting and chemiluminescing by physically separating at least one reagent from the balance of said system, and a light sensitive imaging layer sensitive to the chemiluminescence of said light generating unit, activating said light generating unit such that said light generating unit chemiluminesces, image-wise exposing said light sensitive imaging layer with chemiluminescence reflected from said original, and forming an image in said light sensitive imaging layer.

21. The process of claim 20 wherein said light generating unit comprises an encapsulated reagent and said activating comprises causing said encapsulated reagent to be released.

22. The process of claim 20 wherein said light generating unit comprises a layer having a reagent dispersed in a binder and said activating comprises causing another reagent of said chemiluminescent system to migrate to said layer.

23. The process of claim 20 wherein said activating comprises applying a reagent of said chemiluminescent reaction system to said element.

24. The process of claim 23 wherein said applied reagent is a solvent for said chemiluminescent reaction system.

25. The process of claim 23 wherein said applied reagent is a solution of an oxidizing agent for said chemiluminescent reaction system.

26. The process of claim 21 wherein said encapsulated reagent is a solvent for said chemiluminescent reaction system.

27. The process of claim 21 wherein said encapsulated reagent is a compound which is capable of being transformed to an excited state from which it emits energy.

28. The process of claim 21 wherein said encapsuated reagent is an oxidizing agent for said chemiluminescent reaction system.

29. The process of claim 20 wherein said image-wise exposing is by reflex imaging.

30. The process of claim 20 wherein said image-wise exposing is by direct transmission imaging.

31. The process of claim 20 which further comprises developing said image-wise exposed imaging layer.

32. The process of claim 31 wherein said developing comprises applying a wet developing agent to said imaging layer.

33. The process of claim 31 wherein said developing comprises heating said imaging layer.

34. The process of claim 20 wherein said imaging layer contains a direct print-out material.

35. The process of claims 24, 25 or 26 which further comprises developing said image-wise exposed imaging layer.

36. The process of claim 20 wherein said original is a printed document.

* * * * *